US011719523B2

(12) United States Patent
Saltarelli et al.

(10) Patent No.: US 11,719,523 B2
(45) **Date of Patent: *Aug. 8, 2023**

(54) PERFORATING GUN SYSTEM AND METHOD

(71) Applicant: GEODYNAMICS, INC., Millsap, TX (US)

(72) Inventors: Terrell Saltarelli, Weatherford, TX (US); John T Hardesty, Fort Worth, TX (US)

(73) Assignee: GEODYNAMICS, INC., Millsap, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/233,791

(22) Filed: Apr. 19, 2021

(65) Prior Publication Data

US 2021/0239444 A1 Aug. 5, 2021

Related U.S. Application Data

(63) Continuation of application No. 16/437,754, filed on Jun. 11, 2019, now Pat. No. 11,009,330, which is a continuation of application No. 16/136,459, filed on Sep. 20, 2018, now Pat. No. 10,584,950.

(60) Provisional application No. 62/613,802, filed on Jan. 5, 2018.

(51) Int. Cl.
*F42D 1/05* (2006.01)
*E21B 43/1185* (2006.01)

(52) U.S. Cl.
CPC ..... *F42D 1/05* (2013.01); *E21B 43/1185* (2013.01)

(58) Field of Classification Search
CPC ..... F42D 1/05; E21B 43/1185
USPC ..... 89/1.151
See application file for complete search history.

(56) References Cited

U.S. PATENT DOCUMENTS 3,758,731 A * 9/1973 Vann ..... H01H 3/34 200/61.69
4,441,427 A 4/1984 Barrett
4,817,530 A 4/1989 Florin
5,027,708 A 7/1991 Gonzalez et al.
6,463,857 B1 * 10/2002 Schmid ..... F42B 3/121 102/202.7

(Continued)

FOREIGN PATENT DOCUMENTS

WO 2014089194 A1 6/2014
WO 2017083885 A1 5/2017

OTHER PUBLICATIONS

International Search Report and Written Opinion, dated Jan. 16, 2019, in corresponding/related International Application No. PCT/US18/51868.

(Continued)

*Primary Examiner* — Joshua E Freeman
(74) *Attorney, Agent, or Firm* — Morgan, Lewis & Bockius LLP

(57) ABSTRACT

A detonator block for housing a detonator has a body configured to host the detonator; the body having a first end that is configured to be attached to a sub; the body having a second end, opposite to the first end, and configured to connect to a gun; and a printed circuit board located inside the body, the printed circuit board being electrically connected to the detonator. The body has a holder that is configured to hold the detonator inside the body.

21 Claims, 8 Drawing Sheets

(56) References Cited

U.S. PATENT DOCUMENTS

| | | | | |
|---|---|---|---|---|
| 7,347,278 | B2 * | 3/2008 | Lerche | E21B 43/11857 175/4.55 |
| 7,617,775 | B2 * | 11/2009 | Teowee | H04L 25/061 102/311 |
| 9,080,433 | B2 | 7/2015 | Lanclos et al. | |
| 9,194,219 | B1 | 11/2015 | Hardesty et al. | |
| 9,291,040 | B1 | 3/2016 | Hardesty et al. | |
| 9,581,422 | B2 | 2/2017 | Preiss et al. | |
| 9,689,223 | B2 | 6/2017 | Schacherer et al. | |
| 9,689,238 | B2 | 6/2017 | Hardesty et al. | |
| 9,759,050 | B2 | 9/2017 | Hardesty et al. | |
| 10,400,558 | B1 * | 9/2019 | Shahinpour | E21B 43/1185 |
| 10,458,213 | B1 * | 10/2019 | Eitschberger | E21B 43/119 |
| 10,466,025 | B2 | 11/2019 | Venter et al. | |
| 10,584,950 | B2 * | 3/2020 | Saltarelli | E21B 43/1185 |
| 10,794,159 | B2 * | 10/2020 | Eitschberger | E21B 23/10 |
| 2007/0234921 | A1 * | 10/2007 | Han | E21B 43/1185 102/318 |
| 2008/0134922 | A1 * | 6/2008 | Grattan | F42C 15/005 102/206 |
| 2010/0229749 | A1 * | 9/2010 | Veneruso | F42D 1/05 102/322 |
| 2011/0024116 | A1 * | 2/2011 | McCann | E21B 43/1185 166/55 |
| 2012/0199352 | A1 * | 8/2012 | Lanclos | E21B 43/1185 166/65.1 |
| 2013/0042780 | A1 | 2/2013 | Brooks et al. | |
| 2013/0043074 | A1 | 2/2013 | Tassaroli | |
| 2013/0299194 | A1 * | 11/2013 | Bell | F42B 1/028 73/35.14 |
| 2014/0338552 | A1 * | 11/2014 | Mace | F42C 15/42 102/215 |
| 2015/0000509 | A1 | 1/2015 | Current et al. | |
| 2017/0159420 | A1 * | 6/2017 | Tolman | F42B 3/22 |
| 2017/0198559 | A1 * | 7/2017 | Golian | F42B 3/08 |
| 2017/0268860 | A1 | 9/2017 | Eitschberger | |
| 2018/0045498 | A1 * | 2/2018 | Teowee | F42C 11/06 |
| 2018/0224248 | A1 * | 8/2018 | Lerche | F42B 3/125 |
| 2018/0299239 | A1 * | 10/2018 | Eitschberger | F42D 1/045 |
| 2018/0328702 | A1 * | 11/2018 | Venter | F42D 1/05 |
| 2019/0346243 | A1 * | 11/2019 | Fesshaie | F42B 3/198 |
| 2020/0018139 | A1 * | 1/2020 | Eitschberger | E21B 43/119 |

OTHER PUBLICATIONS

Notice of Allowance in related U.S. Appl. No. 16/136,459 dated Nov. 15, 2019.

Extended European Search Report for corresponding/related European Application No. 18898633.5, dated Aug. 9, 2021.

* cited by examiner

PERFORATING GUN SYSTEM AND METHOD

BACKGROUND

Technical Field

Embodiments of the subject matter disclosed herein generally relate to downhole tools for perforating operations, and more specifically, to a gun string having various components that need to be assembled at the well site, some of the components including explosive materials.

Discussion of the Background

After a well 100 is drilled to a desired depth H relative to the surface 110, as illustrated in FIG. 1, and the casing 102 protecting the wellbore 104 has been installed and cemented in place, it is time to connect the wellbore 104 to the subterranean formation 106 to extract the oil and/or gas.

The process of connecting the wellbore to the subterranean formation may include the following steps: (1) placing a plug 112 with a through port 114 (known as a frac plug) above a just stimulated stage 116, and (2) perforating a new stage 118 above the plug 112. The step of perforating is achieved with a gun string 120 that is lowered into the well with a wireline 122. A controller 124 located at the surface controls the speed of the wireline 122 and also sends various commands along the wireline to actuate one or more guns of the gun string.

A traditional gun string 120 includes plural carriers 126 connected to each other by corresponding subs 128, as illustrated in FIG. 1. Each sub 128 includes a detonator 130 and a switch 132. The detonator 130 is not connected to the through line (a wire that extends from the surface to the last gun and transmits the actuation command to the charges) until a corresponding switch 132 is actuated. The corresponding switch 132 is actuated by the detonation of a downstream gun. When this happens, the detonator 130 becomes connected to the through line, and when a command from the surface actuates the detonator 130, the upstream gun is actuated.

The explosive materials in the detonator and guns are highly dangerous. Thus, the transport of these materials from the manufacturing location to the wellsite poses logistical and safety problems. For these reasons, many manufacturers ship the various components of the gun string unassembled, with the expectation that the gun string would be assembled at the well location.

In this regard, for a conventional perforating gun string 120, carriers 126 are first loaded with charges and a detonator cord. Gun strings are then built up, one gun at a time, by connecting the loaded carriers 126 to corresponding subs 128. These subs contain the switch 132 with pressure bulkhead capabilities. Once the sub is assembled to the gun string, the wires and detonation cord are pulled through the port in the sub, allowing for the installation of the detonator and the connection of the wiring. Those skilled in the field know that this assembly operation has its own risks.

Many existing models of oilfield detonators are available with a fluid-disabling capability. This capability requires that if the detonator is exposed to fluid for some period of time, the detonator will no longer fire. To accomplish this, many models incorporate a hole through the detonator to allow the fluid to enter inside. Some service companies "interrupt" their detonator by inserting a piece of thick copper wire into this hole, which blocks the detonation train. This method is using the detonator outside of the scope of its design, and thus, it is non-compliant with the existing recommended practices.

After a conventional gun string has been assembled, none of the detonators are electrically connected to the through wire or through line running through the gun string. This is because between each gun there is a pressure-actuated single pole double throw (SPDT) switch. The normally closed contact on these switches connects the through wire from gun to gun. Once the switch has been activated by the blast of the gun beneath (when that guns goes off), the switch changes its state, connecting the through wire coming from above to one lead of the detonator. The other lead of the detonator is wired to ground the entire time.

In this configuration, after assembly, the detonator wires are no longer shunted, but rather one wire is tied to the system's ground, while the other is isolated both from the ground and any live wire, until such time the pressure switch associated with the detonator is actuated. The last detonator in the gun string, which is typically hard-wired in place, is not installed until the gun is at the wellsite.

Wiring the gun string is a common source of field failures. In some cases, the wrong wires are connected together. Other times, the connection breaks apart from vibration and/or shock. In conventional systems, the through wire has a tendency to get pinched in the carrier due to the threads used to connect the uphole end. The through wire is typically wrapped around the post of the downhole-facing pressure switch, and runs along the length of the load tube. The wire is fed out at the opposite end of the carrier. As the first end of the carrier is connected, tension must be applied on the through wire to keep it from getting caught in the threads. If the correct tension is not maintained, the slack generated by the shortening of the gun-sub connection (the carrier is 'swallowing' the sub threads) can let the through wire fall into the threads and get pinched.

Thus, mistakes can easily be made by the assembling personal at the well location, which may result in loss of life, safety issues, production delays, etc. The explosive materials are regulated by various government agencies. While these government agencies carve out special exemptions for the storage and transportation of loaded perforating guns, it is still not as safe as assembling the guns at the wellsite.

Thus, there is a need to correct several of these deficiencies by both simplifying the loading process for the personnel servicing the guns, and making safer the assembly and transportation of the perforating gun strings from the manufacturer to the wellsite.

SUMMARY

According to an embodiment, there is a detonator block for housing a detonator, which includes a body configured to host the detonator; the body having a first end that is configured to be attached to a gun assembly element; and the body having a second end, opposite to the first end, and configured to electrically connect to a gun.

According to another embodiment, there is a contact end plate mechanism to be attached to a gun. The contact end plate mechanism includes a body, a front face attached to the body, the front face including a printed board circuit, and a cord holder attached to the front face and configured to hold a detonation cord of the gun.

According to still another embodiment, there is a gun string that includes a gun assembly element, a detonator block mechanically attached to the gun assembly element, and a gun having a carrier. The detonator block is located outside the gun assembly element and inside the carrier.

According to still another embodiment, there is a method for assembling a gun string. The method includes attaching a contact end plate mechanism to a charge load tube of a gun, attaching a detonator block to a gun assembly element, wherein the detonator block includes a detonator, and attaching the gun assembly element to the gun so that the detonator block presses against the contact end plate mechanism.

According to yet another embodiment, there is a downhole tool that includes a first gun assembly element having a contact end plate mechanism and a second gun assembly element having two or more spring-loaded contacts. The contact end plate mechanism has two or more round electrical contacts, the two or more spring-loaded contacts of the second gun assembly make an electrical contact with to the two or more round electrical contacts, and the two or more spring-loaded contacts maintain the electrical contact with the two or more round electrical contacts while the two or more spring-loaded contacts rotate about a longitudinal axis of the downhole tool.

According to another embodiment, there is a contact end plate mechanism that includes a body and a front face attached to the body, the front face including a printed board circuit. The printed board circuit includes plural round electrical contacts and the plural round electrical contacts are electrically insulated from each other.

BRIEF DESCRIPTON OF THE DRAWINGS

The accompanying drawings, which are incorporated in and constitute a part of the specification, illustrate one or more embodiments and, together with the description, explain these embodiments. In the drawings.

and

Figure 8:
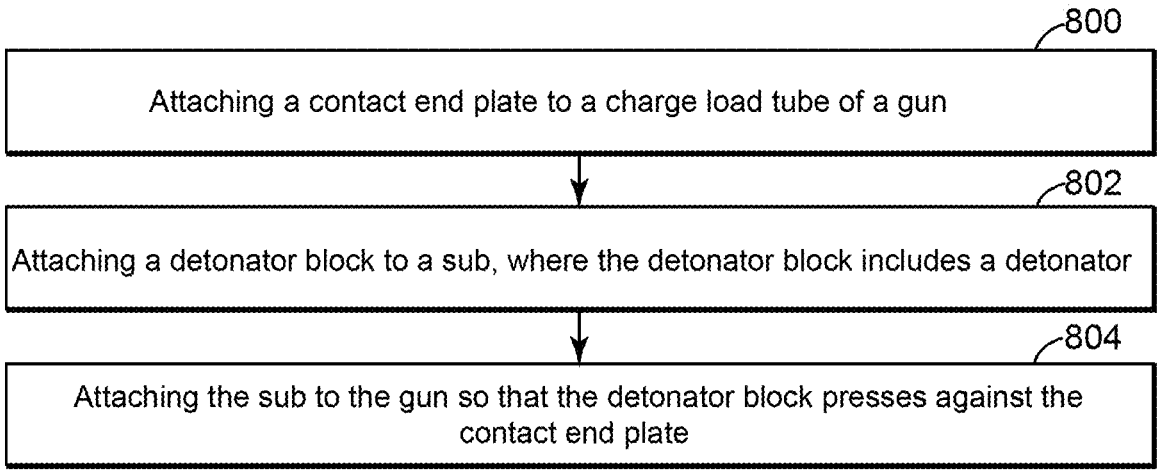

FIG. 8 is a flowchart of a method for assembling a gun string.

DETAILED DESCRIPTION

The following description of the embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to a gun string having two subs and one gun. However, the embodiments discussed herein are applicable to gun strings having many subs and many guns.

Reference throughout the specification to "one embodiment" or "an embodiment" means that a particular feature, structure or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

Figure 1:
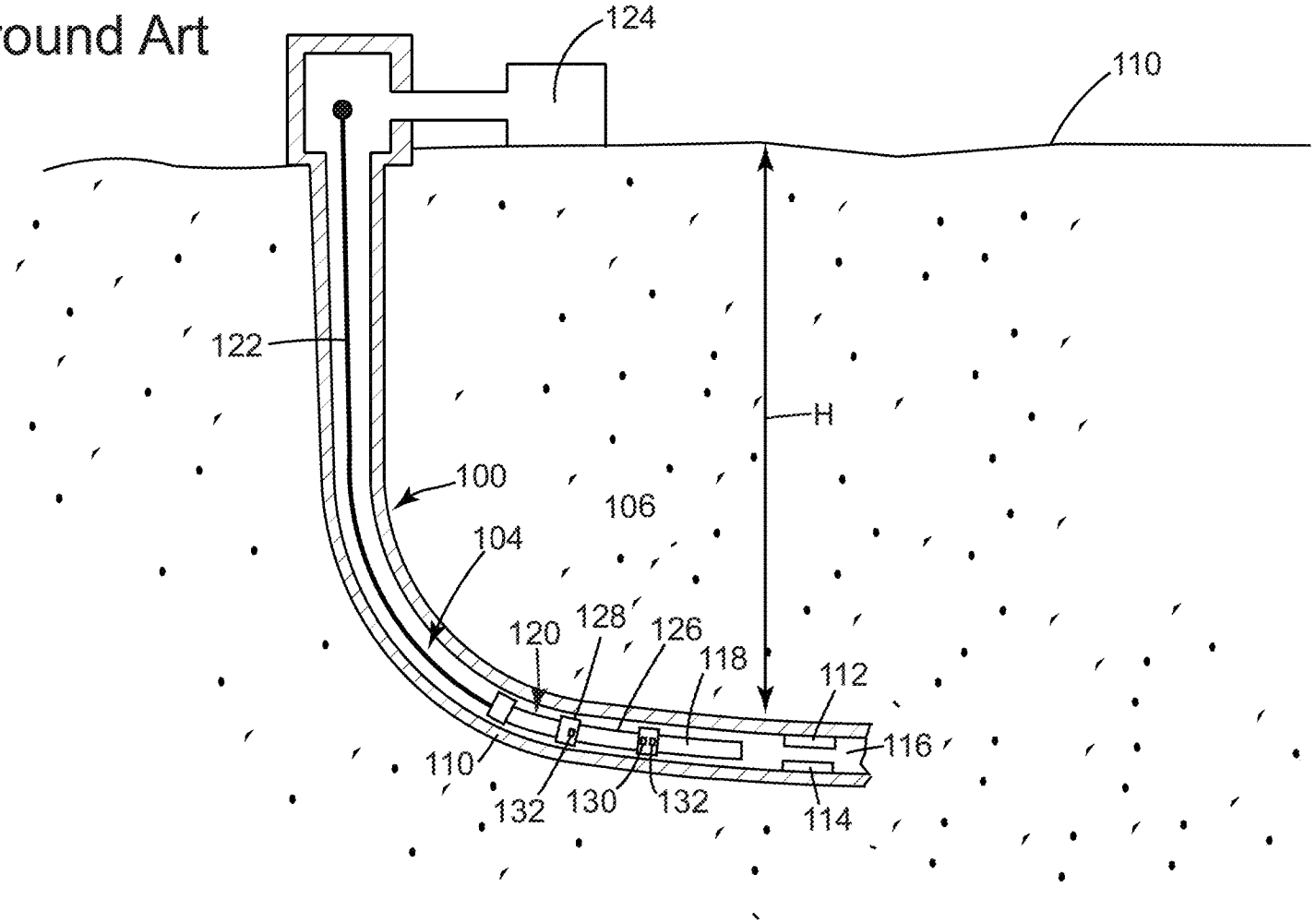
FIG. 1 Background Art
FIG. 1 illustrates a well and associated equipment for well completion operations.
Figure 2:
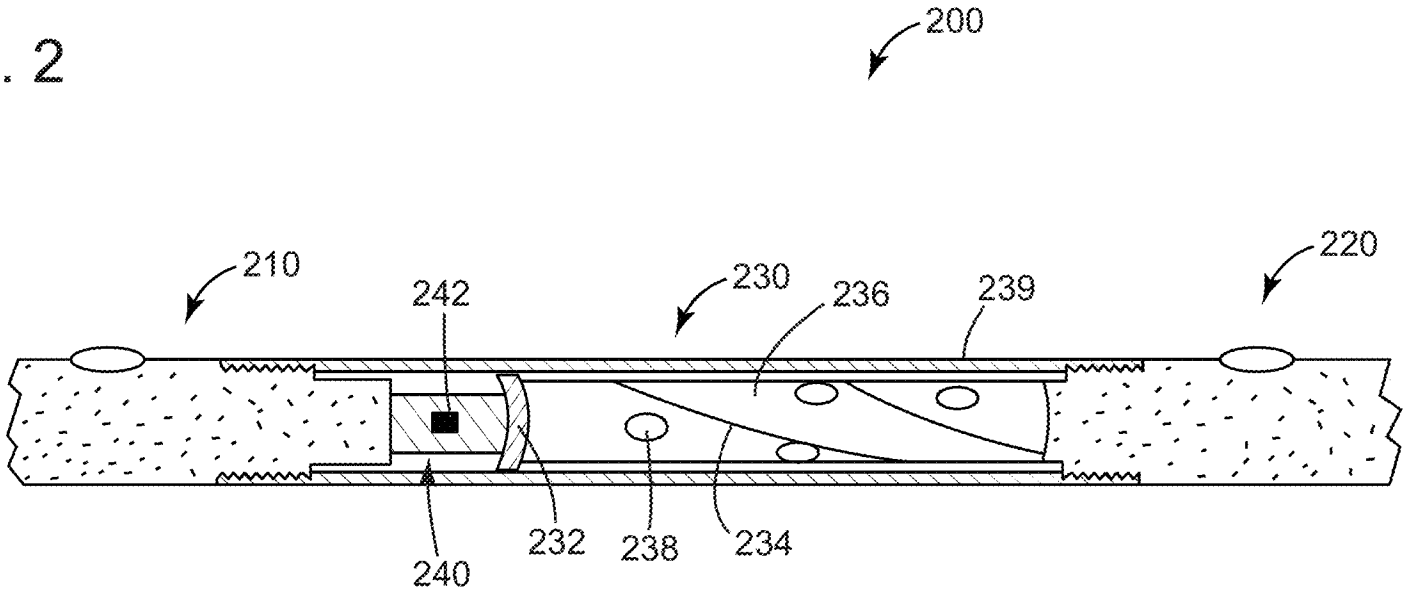
FIG. 2 illustrates a gun string having a detonator block.

According to an embodiment illustrated in FIG. 2, a gun string 200 includes plural subs (only two subs 210 and 220 are shown) and plural guns (only one 230 is shown) connected to each other. When located in the well, the first sub 210 is upstream from the gun 230 and the second sub 220 is downstream. While the traditional gun strings have each gun directly sandwiched between two adjacent subs, according to this embodiment, there is an additional element, a detonator block 240 located between the first sub 210 and the gun 230 and also a contact end plate mechanism 232 that ensures electrical connection between the detonator block 240 and the wires of the gun 230. Contact end plate mechanism 232 also connects to a detonation cord 234 that actuates the charges 238 in the gun 230. FIG. 2 shows the detonation cord 234 being located outside the charge load tube 236. The charge load tube 236 is configured to hold the various charges 238. FIG. 2 also shows carrier 239 connected to the sub 210 and housing the components of the gun. According to this embodiment, a detonator 242 is not located in the sub 210 or 220 as in the traditional gun strings, but in the detonator block 240. This is advantageous because the repeated activation of the detonator slowly damages the sub, which is expensive to replace. However, the cost of the detonator block 240 is lower than the cost of the sub as the detonator block may be made of cheaper materials (e.g., polymers) and thus it can be changed more often. Details of the detonator block 240 and contact end plate mechanism 232 are now discussed.

Figure 3:
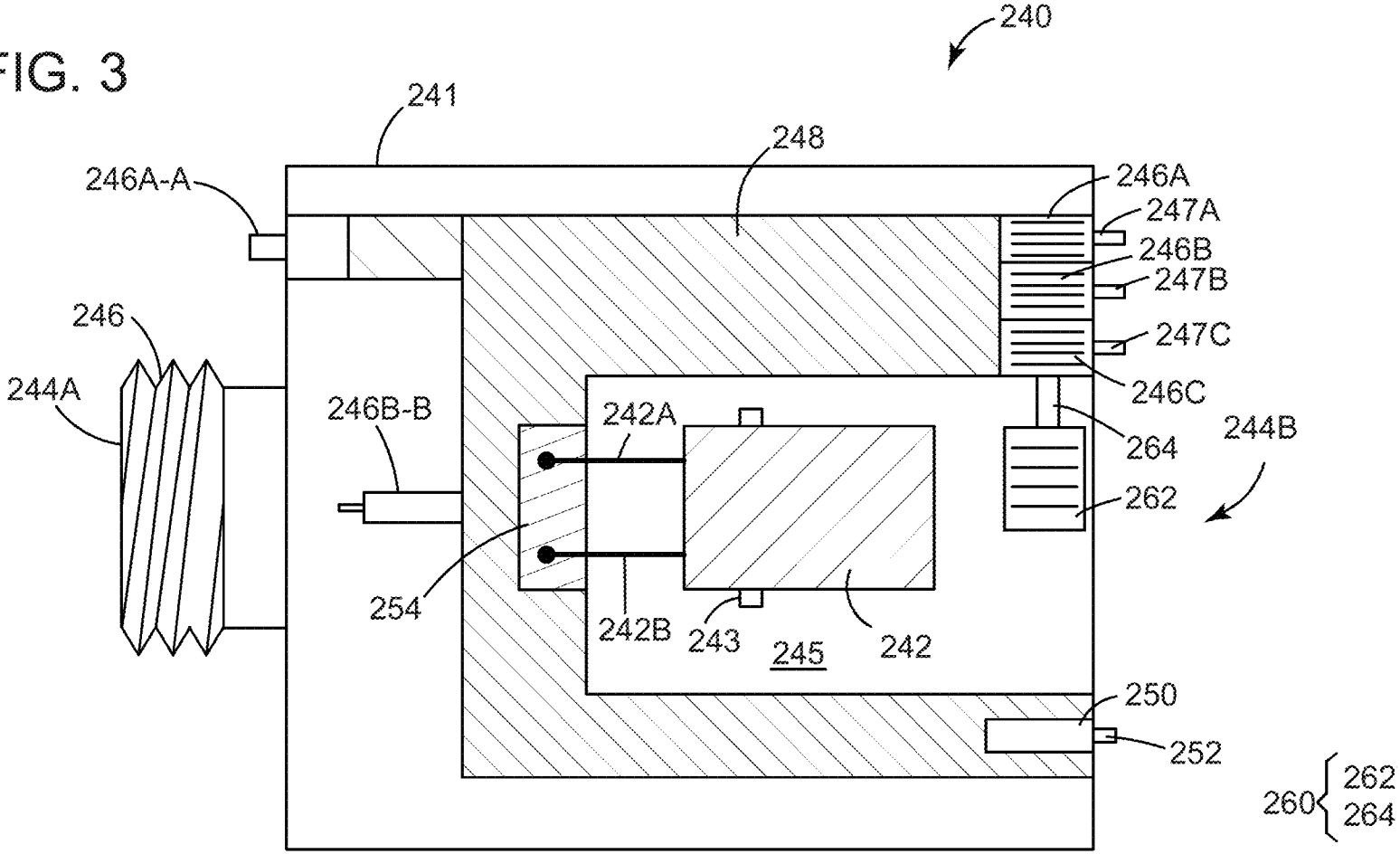
FIG. 3 illustrates an inside of the detonator block.

FIG. 3 shows a half of the detonator block 240 having the detonator 242 installed in a chamber 245 formed in a body 241 of the detonator block. Detonator 242 may be held in place by one or more holders 243 (e.g., off-the-self fuse holders). This means that any type of detonator may be placed inside the detonator block 240. A first end 244A of the body 241 is narrower than the rest of the body and has corresponding threads 246 that are designed to mate with corresponding threads in the sub 210. Note that a traditional sub 210 has a switch retainer nut (not shown in FIG. 2) that holds in place the corresponding switch 132. The present detonator block 240 is configured to replace the switch retainer nut in the sub 210. This means that detonator block 240 screws directly into the body of the first sub 210 when the gun string is assembled.

The second end 244B of the detonator block 240 has a more complex structure. Plural spring-loaded contacts 246A to 246C (more or less contacts may be used in another embodiment) are attached to a printed circuit board (PCB) 248 and located so that corresponding pins 247A to 247C extend beyond the body 241. The PCB 248 is placed inside the detonator block. In one embodiment, the PCB 248 extends around the detonator 242 as shown in FIG. 3. The three spring-loaded contacts 264A to 246C connect to the through-wire, fire-wire and dedicated ground wire, respectively. As will be discussed later, these three electrical contacts connect to corresponding contacts on the contact end plate mechanism 232 discussed with regard to FIG. 2. These connectors are spring loaded to account for any variations in assembly which might otherwise prevent one of the connectors from making contact with a corresponding contact on the contact end plate mechanism.

On the same PCB 248 is located a contact switch 250 which shunts the leads of the detonator 242 when the assembly is not completed. This is a safety feature which prevents an unwanted detonation of the detonator. Note that the detonator cannot be electrically actuated as long as its leads are connected to each other. In this regard, detonator 242 has two leads 242A and 242B that are connected to a wire header 254, which is attached to the PCB 248. The two leads 242A and 242B are shorted by the contact switch 250 when a head 252 of this switch is free, i.e., not in contact with anything. As soon as head 252, which can be made of plastic, is biased by the contact end plate mechanism 232 in FIG. 2, the two leads 242A and 242B are disconnected from each other. However, these leads remain connected to the rest of the circuit. Contact switch 250 may be a normally closed, momentary contact switch.

The PCB 248 electrically connects the ground contact 246A to a corresponding ground pin 246A-A and the through-line contact 246B to a corresponding through-line pin 246B-B. The through-line pin 276B corresponds to the line-in or line-out and the through-line pin 246B-B corresponds to the line-out or line-in. The switch contact 246C is electrically connected to a corresponding switch in a downstream sub and also to the wire header 254 and to the contact switch 250. Pins 246A-A and 246B-B ensure that the ground-line and the through-line continue to the next gun.

The detonator block further includes another safety feature, the interrupter mechanism 260. The interrupter mechanism 260 includes, among other elements, a cap 262 and an arm 264. Cap 262 is placed to block a ballistic connection between the detonator 242 and the detonation cord 234 of the gun 230. This means that even if the detonator 242 is accidentally actuated, the produced pressure waves would not ignite the detonation cord 234 inside the gun 230, and thus, the explosive charges 238 of the gun are not actuated. Cap 262 may have the same or a larger diameter than the detonator 242 for preventing the pressure waves from the detonator to propagate downstream to the gun 230. Note that the detonator block does not have to simultaneously have all the safety features discussed herein. The detonator block may include at least one of these safety features. In one application, the detonator block may include any combination of these safety features.

Figure 4:
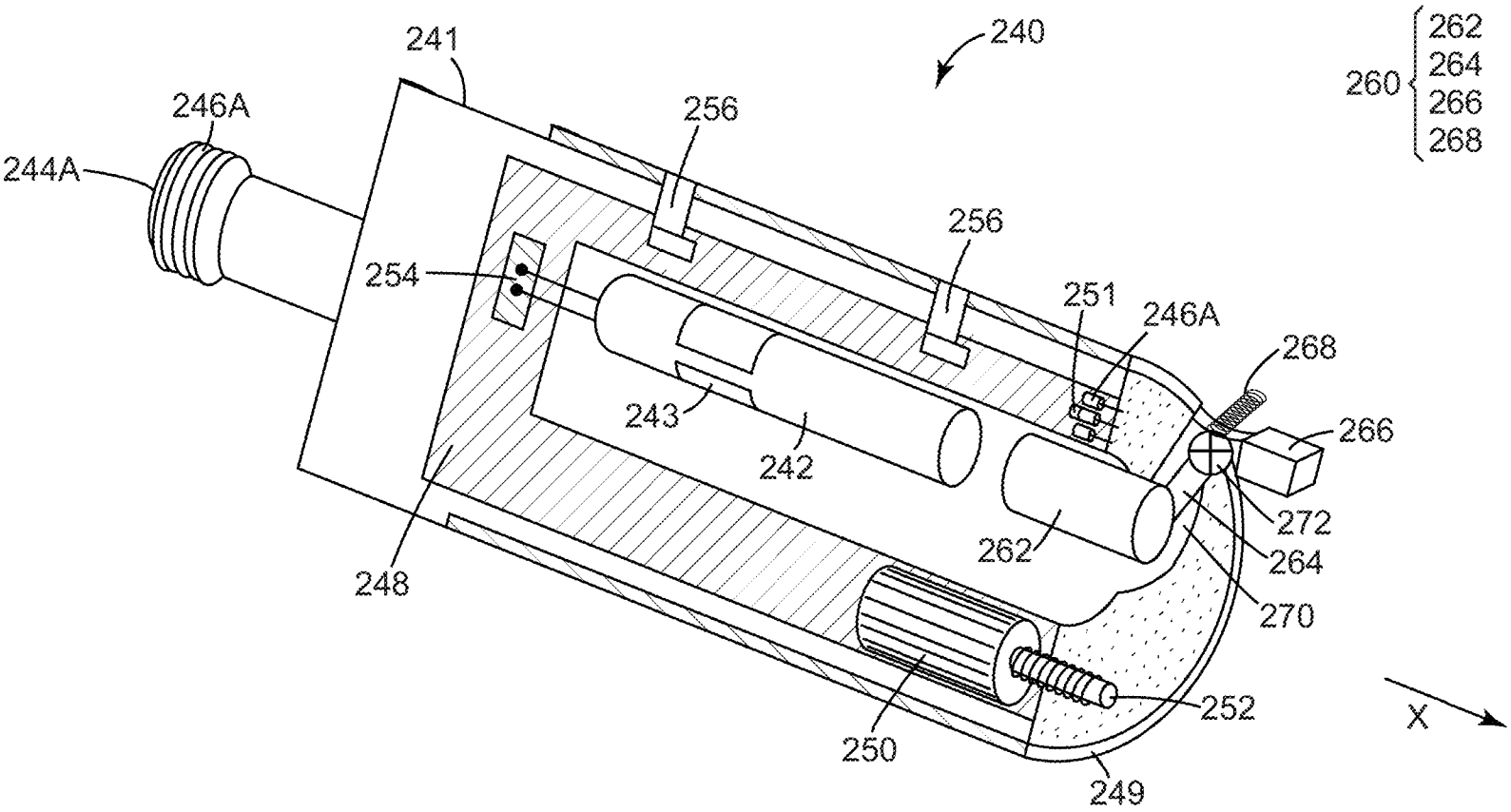
FIG. 4 illustrates various components of the detonator block.

FIG. 4 shows an overview of the detonator block 240 that illustrates the interrupter mechanism 260. In this figure, an interrupter actuator 266 and an interrupter spring 268 can be seen. Note that when the detonator block 240 touches contact end plate mechanism 232 (see FIG. 2), interrupter actuator 266 is pressed inside or along the detonator block, along longitudinal axis X. This movement of the interrupter actuator 266 makes the interrupter spring 268 to swing upwards and thus, arm 264 rotates anti-clockwise. This anti-clockwise movement of the arm 264 makes the cap 262 to move to a side 270 of the interior of the body 241, ensuring ballistic contact (i.e., clear path) between the detonator 242 and the detonator cord 234 in the gun 230. Arm 264 may be attached to the body 241 with a screw 272. Interrupter actuator 266 may have a spring (not shown) for pushing the actuator back when the detonator block is not in contact with the contact end plate mechanism.

FIG. 4 also shows two clamps 256 (more are possible) attached to the half of the body 241. These clamps fit into corresponding mating members on the other half of the body 241. Thus, after the detonator 242 and PCB 248 are placed inside one half of the body 241, the other half of the body 241 can be simply snapped in place. Those skilled in the art would understand that other means for connecting the two halves may be used, for example, screws. Also, it is possible that the body of the detonator block 240 is made of more than two parts.

Another safety feature that may be added to the detonator block is now discussed with regard to FIG. 4. The PCB 248 not only makes the electrical connections between the various elements of the detonator block, but in one application it may also be used to form a Faraday cage to protect the detonator 242 from electromagnetic interference. In this application, the entire back plane of the PCB 248 may be made to be a ground plane and a conductive foil 249 may be added to the exterior of the detonator block, to act as the Faraday cage. The foil 249 may be added with an adhesive tape to the external side of the detonator block. The foil needs to be positioned to not interfere with the movement of the interrupter mechanism.

Figure 5:
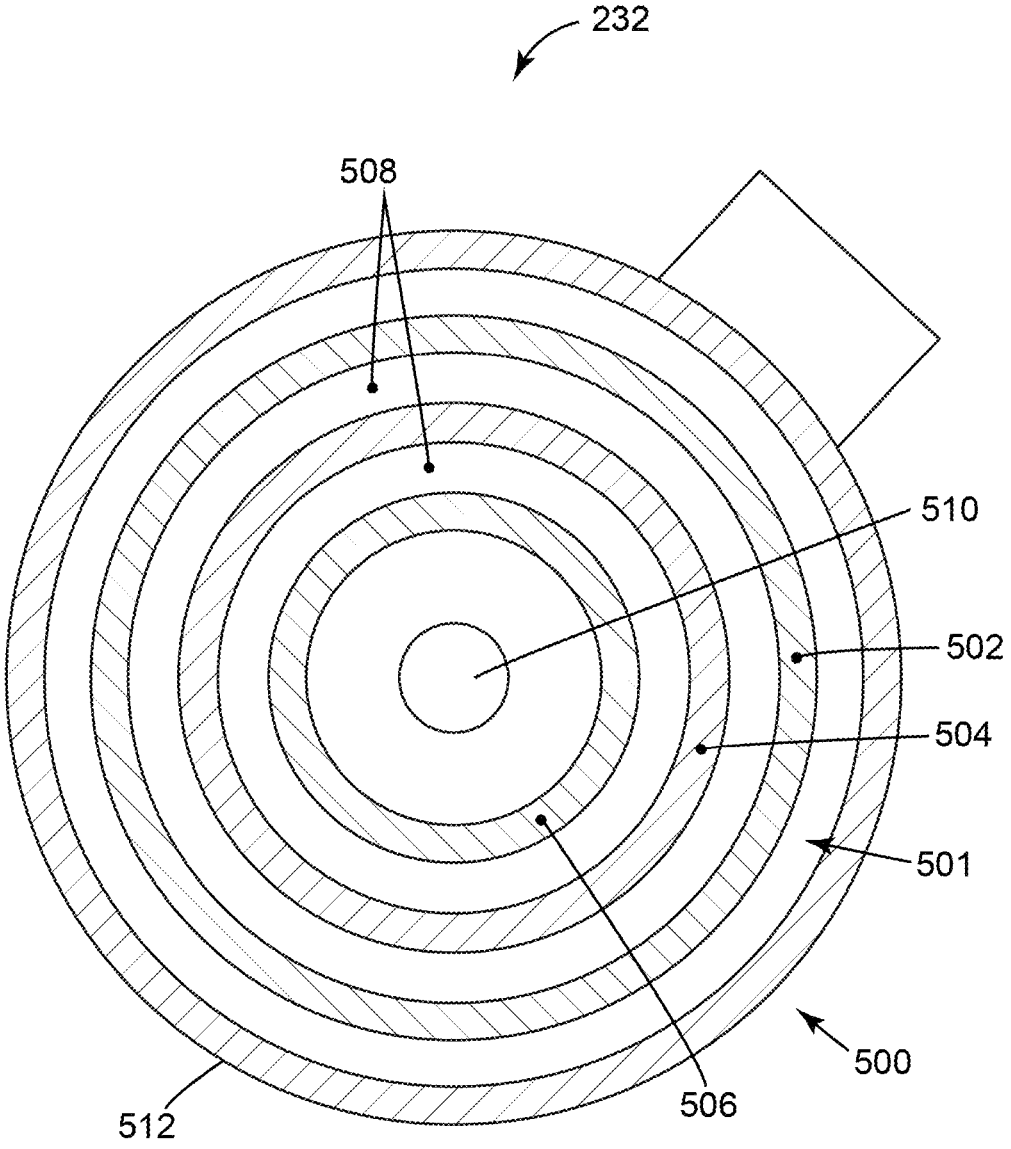
FIG. 5 illustrates a contact end plate mechanism.
Figure 6:
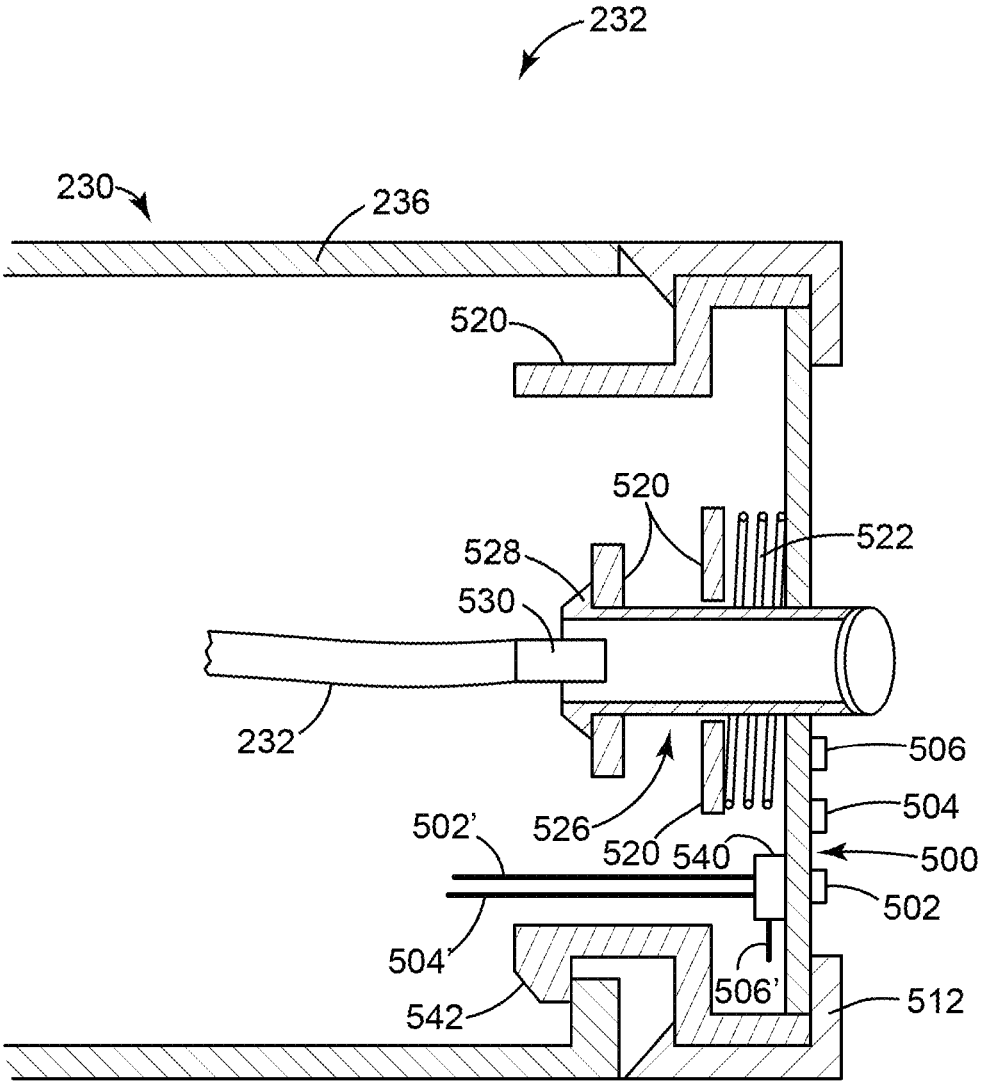
FIG. 6 illustrates various components of the contact end plate mechanism.

The configuration of the contact end plate mechanism 232 is now discussed with regard to FIGS. 5 and 6. Note that the contact end plate mechanism 232 takes the place of a conventional upstream endplate for a gun. FIG. 5 shows a front face 500 of the contact end plate mechanism 232 and this front face electrically and mechanically connects to the detonator block 240. For achieving the electrical connection with the detonator block, the front face includes a printed circuit board 501 that has three electrical contacts (other number may be used in other applications) 502, 504 and 506 which are electrically separated from each other by insulating zones 508. The electrical contacts 502, 504 and 506 may be formed as rings on the printed circuit board. In one application, these electrical contacts may have another shape.

One skilled in the art would appreciate at least two advantages of these electrical contacts. First, the process of making these contacts (i.e., treating a printed circuit board to have three concentric rings) is easier and cheaper than stamping metal contacts as currently done in the industry. Second, the current guns require an accurate alignment of the various components for matching the electrical contacts of these various components. In the present embodiments, the three electrical contacts 246A, 246B and 246C of the detonator block 240 and the corresponding three electrical contacts 502, 504, and 506 of the contact end plate mechanism 232 do not need to exactly match each other because of the circular shape of the contacts 502, 504, and 506. In other words, the electrical contacts of the detonator block may be rotated in any way relative to their longitudinal axis X and they still contact the electrical contacts of the contact end plate mechanism. Further, even if there is a gap between the detonator block and the contact end plate mechanism along the axis X, because of the springs biasing the pins of the electrical contacts of the detonator block against the contact end plate mechanism, a good electrical contact is achieved between the detonator block and the contact end plate mechanism. Thus, assembly of the detonator block and the contact end plate mechanism is simplified as no precise alignment of the two parts is required.

In one embodiment, the downhole tool 200 includes a first gun assembly element (e.g., gun 230) having a contact end plate mechanism 232 and a second gun assembly element (e.g., detonator block 240) having two or more spring-loaded contacts 246A, 246B. The two or more spring-loaded contacts 246A, 246B of the second gun assembly 240 make an electrical contact with to the two or more round electrical contacts 502, 504. In this embodiment, the two or more spring-loaded contacts 246A, 246B maintain the electrical contact with the two or more round electrical contacts 502, 504 while the two or more spring-loaded contacts rotate about a longitudinal axis of the downhole tool.

The contact end plate mechanism 232 shown in FIG. 5 also has a central hole 510, through which the pressure waves from the detonator ballistically communicate with the detonator cord that is attached behind the PCB front face 500 (see FIG. 6). FIG. 5 also shows a bracket 512 that maintains the PCB front face 500 attached to the contact end plate mechanism 232. This feature is better seen in FIG. 6. This figure shows the body 520 of the contact end plate mechanism 232, the PCB front face 500 being in contact with the body 520, and the bracket (or retainer) 512 clipping the PCB front face 500 to the body 520. Optionally, a spring 522 may be placed between the body 520 and the back of the PCB front face 500 to bias it against the detonator block.

FIG. 6 also shows a cord holder 526 that enters through the central hole 510 of the PCB front face 500 and attaches to the body 520 of the contact end plate mechanism 232, for example, with clamps 528. The detonation cord 234 is shown having a bidirectional booster 530 and both the detonation cord and the bidirectional booster attach to an inside the cord holder 526. In this way, the detonation cord is centered relative to the PCB front face and also aligned with the opening 510 so that the pressure waves from the detonator can ignite the bidirectional booster. The bidirectional booster is a more sensitive element for making sure that the pressure waves from the detonator ignite the detonation cord.

However, the bidirectional booster is not required and there are guns that do not use such boosters.

On the back of the PCB front face 500, an electrical connector 540 may be attached and this connector electrically connects the three electrical contacts 502, 504, and 506 to corresponding wires 502', 504' and 506' for extending the ground, through-wire and fire-wire along the gun 230. FIG. 6 shows the gun 230 having the contact end plate mechanism 232 attached to the charge load tube 236. The charge load tube is discussed later and is used to hold the charges 238 that are detonated in the well for connecting the formation to the interior of the well. The detonation cord 234 actuates these charges and this cord is shown in FIG. 2 being located around the charge load tube 236.

To attach the contact end plate mechanism 232 to the charge load tube 236, one or more clamps 542 may be used. In one application, the one or more clamps 542 may be formed in the body 520 of the contact end plate mechanism 232, as shown in FIG. 6. However, those skilled in the art would understand that other methods and means for attaching the contact end plate mechanism to the charge load tube may be used (e.g., using a twist-lok type of interface). In one application, for example, threads may be formed in the body 520 of the contact end plate mechanism and the charge load tube and the contact end plate mechanism may be screwed to the charge load tube. The clamps shown in FIG. 6 are more advantageous because no twist of the internal wires is produced and also using clamps is cheaper and faster than screwing the contact end plate mechanism.

Figure 7:
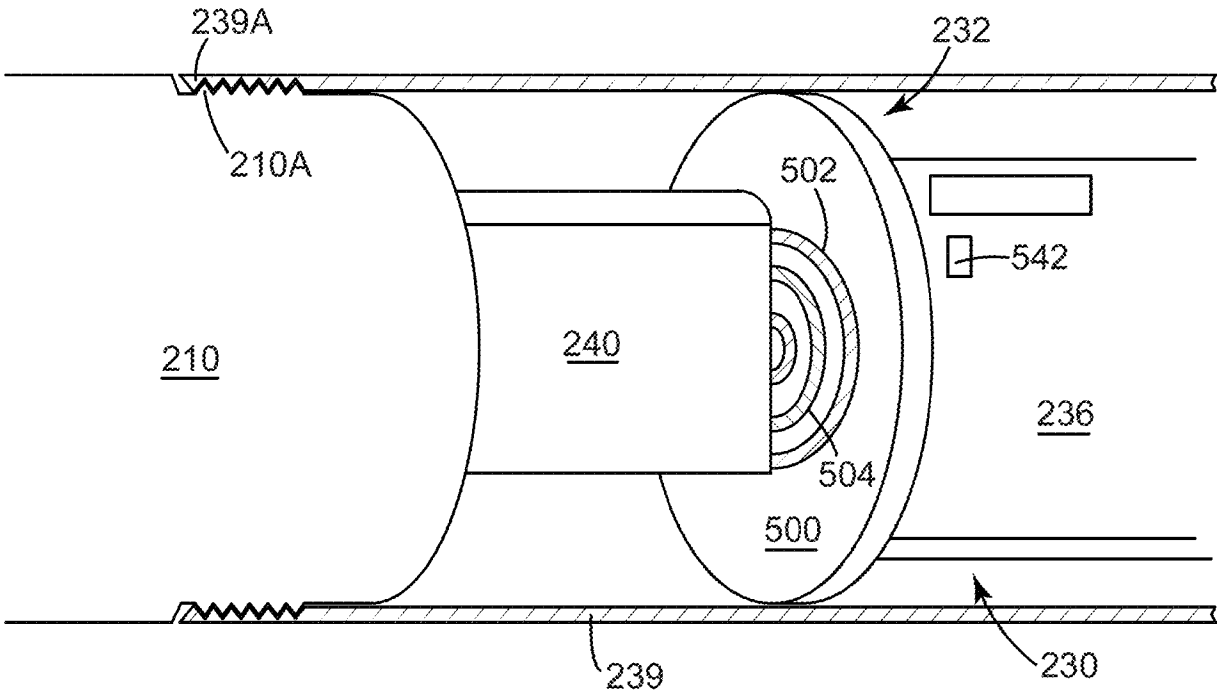
FIG. 7 illustrates a sub connected to a gun through a detonator block.

FIG. 7 shows the detonator block 240 mechanically attached to the first sub 210 and the detonator block 240 also in electrical and mechanical contact with the contact end plate mechanism 232. Note that in another embodiment, first sub 210 can be replaced with another gun. In this embodiment, the detonator block 240 is connected between first gun 210 and second gun 230. Thus, reference sign 210 indicates a gun assembly element, which can be a sub, a gun, or other component of the gun assembly. The contact end plate mechanism 232 is already attached to the charge load tube 236 of gun 230. When the detonator block 240 is mechanically and electrically attached to the contact end plate mechanism 232, as in FIG. 7, the contact switch 250 touches the contact end plate mechanism, which de-shunts the leads of the detonator 242. In addition, the mechanical contact between the detonator block and the contact end plate mechanism pushes the interrupter actuator 266 (see FIG. 4) along the axis X, which results in the cap 262 clearing the path between the detonator 242 and the detonator cord 234, i.e., achieving a ballistic communication. Further, when the detonator block 240 is in mechanical contact with the contact end plate mechanism 232, the spring-loaded contacts 246A, 246B and 246C electrically connect to the contacts 502, 504 and 506 of the contact end plate mechanism 232.

As discussed above with regard to FIG. 6, the contact end plate mechanism 232 connects to the charge load tube 236 via snap tabs 542, which are also shown in FIG. 7. The contact end plate mechanism 232 can be made from a variety of materials and with plural manufacturing methods (e.g., injection molding plastic). The contact end plate mechanism 232 and the change load tube 236 are located inside the carrier 239. Carrier 239 connects to the sub 210 by mating threads 239A and 210A at a first end of the carrier. The carrier 239 connects to the second sub 220 (shown in FIG. 2) with corresponding mating threads (not shown) similar to the threads 239A and 210A. Carrier 239 protects the other components of the gun 230 from the fluid present inside the well. Note that the detonation block is screwed to the sub and located outside the sub. Also, in this embodiment, the detonation block is located inside the carrier 239, but outside the change load tube 236.

According to an embodiment, when the detonator block 240 is not in mechanical contact with the contact end plate mechanism, i.e., when the detonator block is not assembled, the leads of the detonator 242 are shunted (a first safety protection), and the interrupter 260 ballistically isolates the detonator (a second safety protection) from the detonator cord.

Because of these features, the detonator block and the contact end plate mechanism can be shipped from the manufacturer site to the well site in a variety of ways. According to one approach, a complete gun string can be shipped as it poses no more danger than shipping a conventional gun string. Another approach is to ship gun subassemblies in a palletized manner, with the detonator blocks attached to the respective subs. This is safe, as the detonator is on the opposite side of a pressure bulkhead from the secondary explosive, and is shunted by contact switch 250 and interrupted by interrupter mechanism 260. Still another approach would be to keep the detonator blocks separate from the carrier assemblies, and have them installed right before sending the gun string into the well.

While the various features illustrated above have been discussed in the context of the oil and gas industry, those skilled in the art would understand that the novel features are applicable to devices in any field. For example, the rotatable multipin connection between the detonator block and the contact end plate mechanism utilizing the printed circuit board as an electromechanical connection may be used in the electronics field. The spring loading of the pins 247A to 247C may account for tolerances in makeup and add practicality to any two elements that need to be electrically connected. Furthermore, the cost of such PCB connector is much below other multipin designs.

The electrical connections of the gun string, un-shunting and un-interrupting the detonator may be all performed when one gun 230 is attached to the next during thread makeup. These actions can be timed such that the electrical connections are made first, while the detonator is still shunted and interrupted. A fuse 251 (see FIG. 4) may be placed on the PCB 248 so that if there is power on the line, and the pressure switch is switched on (or there is another wiring error), the fuse will burn open by passing current through the contact switch 250 before the leads of the detonator 242 are unshunted. The fuse 251, which would be on the through-line coming into the detonator block 240, would be sized such that the normal current draw to set off a detonator would not blow the fuse, but the higher current drawn by a dead short would. By connecting the electrical connections 502, 504, and 506 first, any residual static charges in the detonator block is equalized with the adjacent gun through an integrated redundant ground connector, which makes contact with the un-plated portion of the switch sub. Next, the detonator is un-shunted. Finally, the cap of the interrupter mechanism moves out of the way. This is the safest sequence of operations, but any combination thereof could be utilized. The PCB 248 may also contain additional components and circuitry to incorporate addressable switching functionality, eliminating the need for a standalone pressure switch. Furthermore, circuitry can be added, either in conjunction with or standalone of, the addressable switch circuitry to provide additional RF protection, such as a capacitor across the detonator leads.

A method for assembling a gun string is now discussed with regard to FIG. 8. The method includes a step 800 of attaching a contact end plate mechanism to a charge load tube of a gun, a step 802 of attaching a detonator block to a sub, where the detonator block includes a detonator, and a step 804 of attaching the sub to the gun so that the detonator block presses against the contact end plate mechanism.

The contact end plate mechanism 232 to be attached to a gun 230, includes a body 520; a front face 500 attached to the body 520, the front face including a printed board circuit 501; and a cord holder 526 attached to the front face 500 and configured to hold a detonation cord of the gun. In one application, the printed board circuit includes plural electrical contacts 502, 504. The plural electrical contacts are circular and formed on an external face of the printed circuit board. In one application, the contact end plate mechanism may also include an electrical connector 540 formed on an internal face of the printed board circuit, which is opposite to the plural electrical contacts, wherein the electrical connector electrically connects each of the plural contacts to a corresponding ground line and through line. The contact end plate mechanism may also include a retainer 512 that attaches the front face to the body with clamps, where the cord holder is attached with clamps to the body. In one application, the body has clamps that connect to one end of a charge load tube of the gun.

In another embodiment, a contact end plate mechanism includes a body 520 and a front face 500 attached to the body 520, the front face including a printed board circuit 501. The printed board circuit includes plural round electrical contacts 502, 504, and the plural round electrical contacts are electrically insulated from each other. The plural round electrical contacts may be circular. The printed board circuit has a central opening. The plural round electrical contacts are configured to achieve corresponding electrical connections with plural spring-loaded contacts 246A, 246B. The corresponding electrical contacts are maintained when the plural round electrical contacts rotate or the plural spring-loaded contacts rotate.

In one embodiment, a downhole tool 200 includes a first gun assembly element 230 having a contact end plate mechanism 232 and a second gun assembly element 240 having two or more spring-loaded contacts 246A, 246B. The contact end plate mechanism 232 has two or more round electrical contacts 502, 504, wherein the two or more spring-loaded contacts 246A, 246B of the second gun assembly 240 make an electrical contact with to the two or more round electrical contacts 502, 504 and where the two or more spring-loaded contacts 246A, 246B maintain the electrical contact with the two or more round electrical contacts 502, 504 while the two or more spring-loaded contacts rotate about a longitudinal axis of the downhole tool.

In one application, the first gun assembly is a gun and the second gun assembly is a detonator block. The two or more round electrical contacts 502, 504 are circular. The two or more round electrical contacts 502, 504 are formed on a printed circuit board and are circular.

The disclosed embodiments provide methods and systems for assembling in a more safer manner a gun string. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. A detonator block for housing a detonator, the detonator block comprising:

a body configured to host the detonator;

the body having a first end that is configured to be attached to a sub;

the body having a second end, opposite to the first end, and configured to connect to a gun;

a detonator located inside the body; and a printed circuit board located inside the body, the printed circuit board being electrically connected to the detonator, wherein the printed circuit board is shaped to extend around the detonator.

2. The detonator block of claim 1, further comprising: a holder located in the body and configured to hold the detonator.

3. The detonator block of claim 1, further comprising:

plural electrical contacts electrically connected to the printed circuit board, at least one electrical contact being a spring loaded contact having a respective pin.

4. The detonator block of claim 1, further comprising:

a contact switch electrically connected to the printed circuit board and having a head, wherein the contact switch electrically shunts the detonator when the head is not pressed.

5. The detonator block of claim 4, wherein the contact switch un-shunts leads of the detonator when the head is pressed in.

6. The detonator block of claim 5, further comprising:

a fuse located on the printed circuit board and configured to burn open by passing a current through the contact switch before the leads of the detonator are unshunted.

7. The detonator block of claim 1, further comprising:

addressable switch circuitry for selectively switching the detonator.

8. The detonator block of claim 1, further comprising:

an interrupter mechanism configured to block a ballistic path between the detonator and the second end of the body.

9. The detonator block of claim 8, wherein the interrupter mechanism comprises:

a cap;

an arm attached to the cap;

a spring; and an actuator, wherein the actuator makes the cap to move away from the detonator.

10. The detonator block of claim 1, further comprising:

a metallic foil attached to an exterior of the body, wherein the metallic foil together with a ground plane formed on the printed circuit board forms a Faraday cage to protect the detonator from radio frequency interference.

11. A gun string comprising:

a sub;

a detonator block mechanically attached to the sub; and a gun mechanically attached to the sub, wherein the detonator block has an interior chamber that hosts a printed circuit board and a detonator, wherein the detonator is electrically connected to the printed circuit board, and wherein the printed circuit board is shaped to extend wrap around the detonator inside the chamber.

12. The gun string of claim 11, wherein the detonator block is screwed into an end of the sub.

13. The gun string of claim 11, wherein the gun has a contact end plate mechanism attached to a charge load tube and both the contact end plate mechanism and the charge load tube are located inside the carrier.

14. The gun string of claim 13, wherein the detonator block has plural spring-loaded electrical contacts and the contact end plate mechanism has corresponding plural circular electrical contacts.

15. The gun string of claim 11, wherein the detonator block further comprises: addressable switch circuitry for selectively switching the detonator.

16. The gun string of claim 11, wherein the detonator block comprises:

an interrupter mechanism configured to block a ballistic path between the detonator located inside the detonator block and a detonator cord attached to the contact end plate mechanism.

17. A detonator block for housing a detonator, the detonator block comprising:

a body having a chamber that is configured to host the detonator;

the body having a first end that is configured to be attached to a sub;

the body having a second end, opposite to the first end, and configured to connect to a gun; and a printed circuit board located inside the chamber of the body, the printed circuit board being electrically connected to the detonator, and wherein the printed circuit board is shaped to extend around the detonator inside the chamber; and an interrupter mechanism configured to block a ballistic path between the detonator and the second end of the body.

18. The detonator block of claim 17, further comprising:

the detonator.

19. The detonator block of claim 17, further comprising:

plural electrical contacts electrically connected to the printed circuit board, at least one electrical contact being a spring loaded contact having a respective pin.

20. The detonator block of claim 19, further comprising:

a contact switch electrically connected to the printed circuit board and having a head, wherein the contact switch electrically shunts the detonator when the head is not pressed.

21. The detonator block of claim 17, wherein the interrupter mechanism comprises:

a cap;

an arm attached to the cap;

a spring; and an actuator, wherein the actuator makes the cap to move away from the detonator.

* * * * *